US009932782B2

(12) United States Patent
Bjørnenak

(10) Patent No.: US 9,932,782 B2
(45) Date of Patent: Apr. 3, 2018

(54) WELL INTERVENTION CABLE BENDING RESTRICTION FOR A RIGID RESILIENT ROD-SHAPED INTERVENTION CABLE

(71) Applicant: C6 TECHNOLOGIES AS, Stavanger (NO)

(72) Inventor: Mads Bjørnenak, Kristiansand S (NO)

(73) Assignee: C6 TECHNOLOGIES AS, Stavanger (NO)

( * ) Notice: Subject to any disclaimer, the term of this patent is extended or adjusted under 35 U.S.C. 154(b) by 445 days.

(21) Appl. No.: 14/759,563

(22) PCT Filed: Jan. 9, 2013

(86) PCT No.: PCT/NO2013/050005

§ 371 (c)(1),
(2) Date: Jul. 7, 2015

(87) PCT Pub. No.: WO2014/109642

PCT Pub. Date: Jul. 17, 2014

(65) Prior Publication Data

US 2015/0345235 A1 Dec. 3, 2015

(51) Int. Cl.
*E21B 17/05* (2006.01)
*E21B 19/08* (2006.01)
(Continued)

(52) U.S. Cl.
CPC ..... *E21B 19/08* (2013.01); *E21B 17/20* (2013.01); *E21B 19/22* (2013.01)

(58) Field of Classification Search
CPC ..... E21B 17/20; E21B 17/085; E21B 17/015; E21B 17/017; E21B 17/05; F16L 27/04; H02G 3/0475
See application file for complete search history.

(56) References Cited

U.S. PATENT DOCUMENTS 1,886,820 A * 11/1932 Lee ..... E21B 7/06 175/74
3,627,356 A * 12/1971 Anderson ..... E21B 7/067 175/61

(Continued)

FOREIGN PATENT DOCUMENTS

WO WO 2011/096820 A2 8/2011

*Primary Examiner* — Kipp C Wallace
(74) *Attorney, Agent, or Firm* — Birch, Stewart, Kolasch & Birch, LLP

(57) ABSTRACT

A bending restrictor for a rigid but resilient rod-shaped intervention cable includes a series of pipe sections and articulation sleeves. Each pipe section includes a straight pipe piece with a spherical sector in either end. Each articulation sleeve includes two axially oppositely directed spherical-sector seats for holding about each pipe's spherical sector. The spherical sector seats are arranged in either ends of a central axial passage for the intervention cable. Two guide sheaves each with its sheave groove reside in the articulation sleeve's axial plan is laterally displaced relative to the middle of the axial passage so as for enveloping the axial passage for the intervention cable. The articulation sleeve is provided with two opposite axially directed and flattened pivot funnels, and each pivot funnel is provided with its narrower end in adjacent to each its spherical-sector seat. Each pivot funnel has, in the axial plane a funnel shape which allows the pipe section's straight pipe piece to pivot about the spherical sector seat in the axial plane, and wherein the pivot funnel's funnel shape is flattened in another axial plane perpendicular to the first axial plane, so as for the pipe sections to be able to pivot only in the first axial plane. The articulation sleeve is splittable in the plane into two articulation sleeve half housings.

20 Claims, 9 Drawing Sheets

(51) Int. Cl.
*E21B 17/20* (2006.01)
*E21B 19/22* (2006.01)

(56) References Cited

U.S. PATENT DOCUMENTS

| | | | | |
|---|---|---|---|---|
| 4,091,867 | A | 5/1978 | Shannon, Jr. et al. | |
| 4,484,641 | A * | 11/1984 | Dismukes | E21B 7/06 175/61 |
| 4,842,059 | A * | 6/1989 | Tomek | E21B 17/05 166/242.2 |
| 5,538,092 | A * | 7/1996 | Precopia | E21B 17/20 175/320 |
| 7,810,556 | B2 | 10/2010 | Havinga | |
| 2009/0200284 | A1 | 8/2009 | Sanchez | |

* cited by examiner

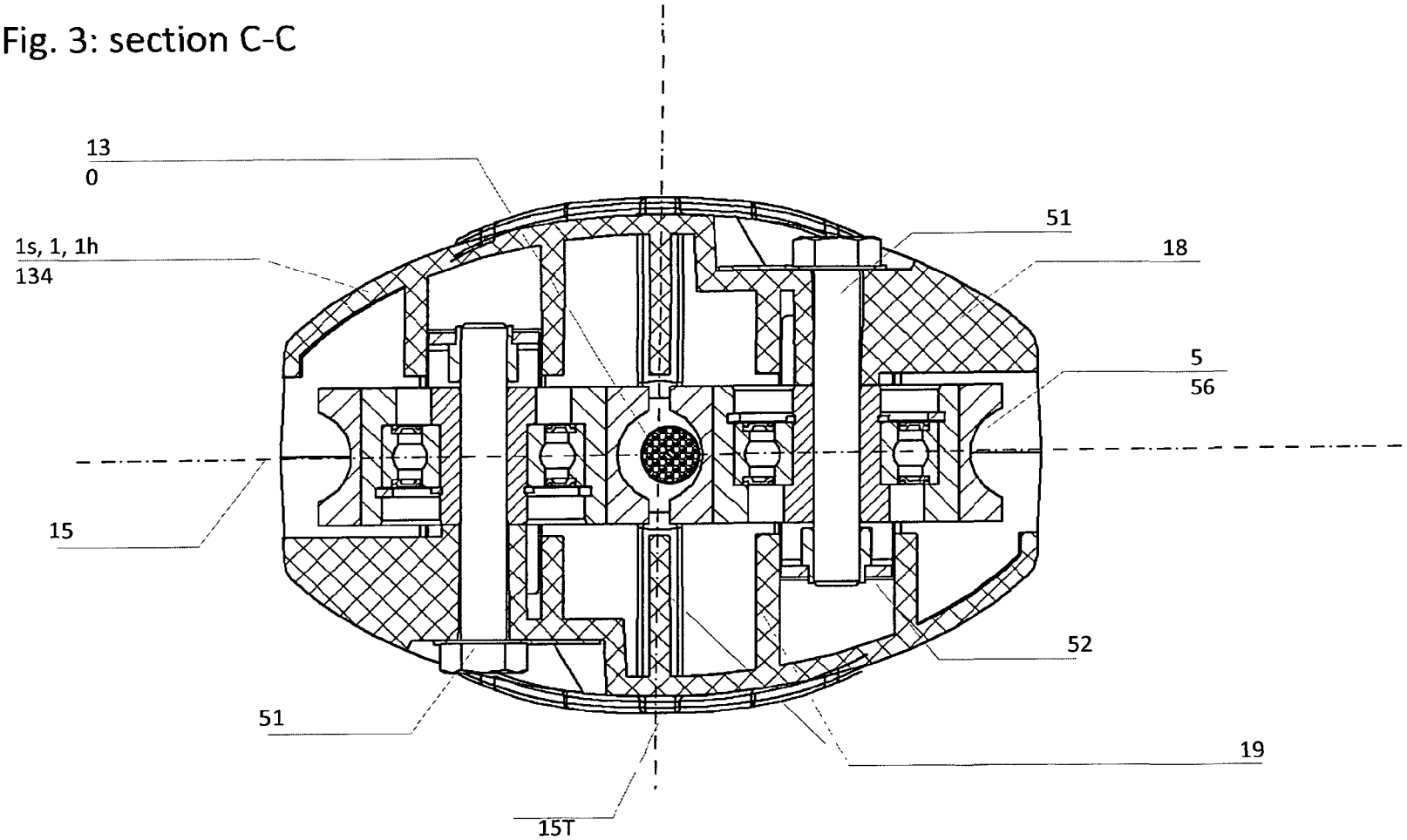
Fig. 3: section C-C

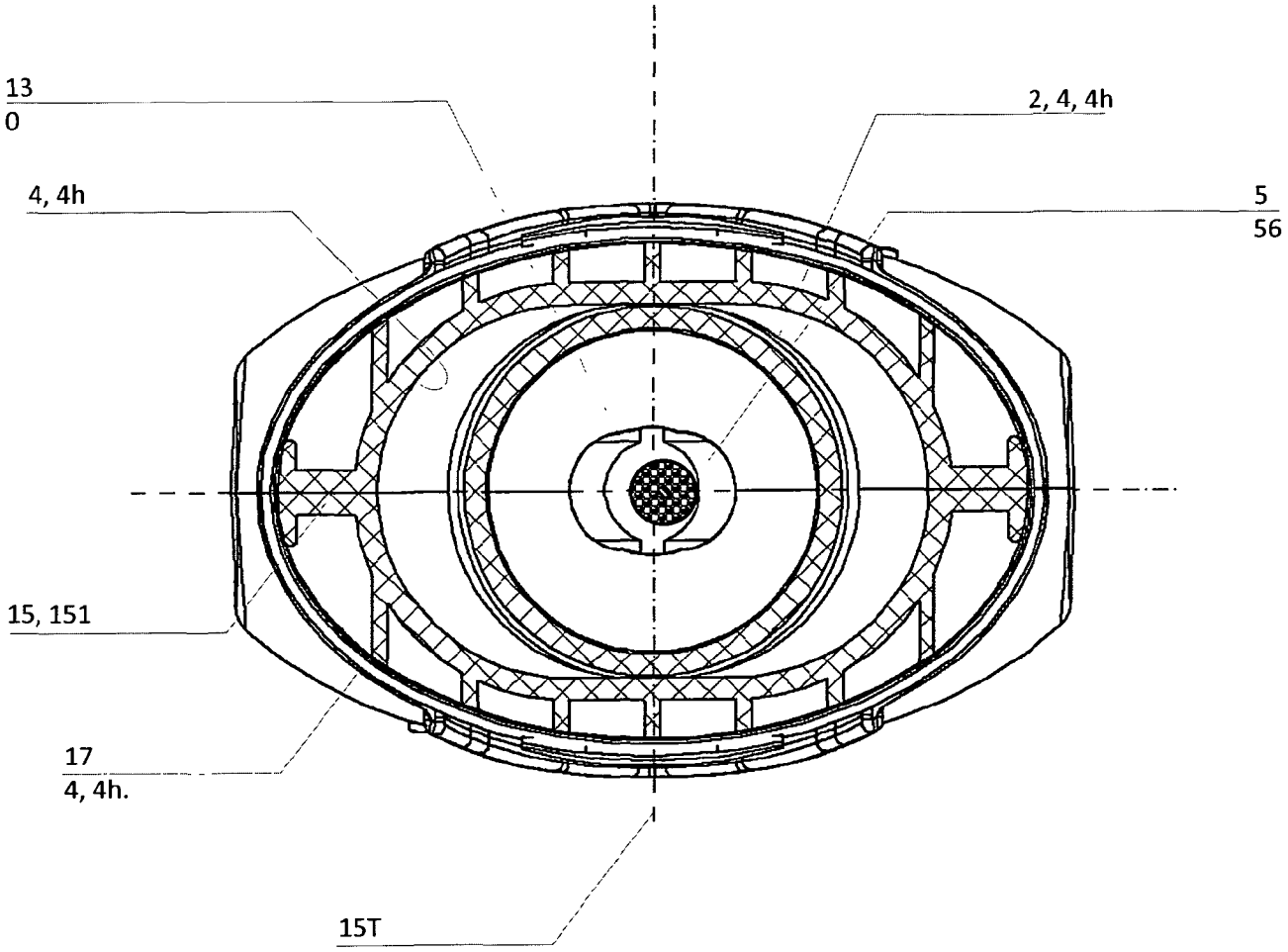
Fig. 4: section A-A (section B-B)

WELL INTERVENTION CABLE BENDING RESTRICTION FOR A RIGID RESILIENT ROD-SHAPED INTERVENTION CABLE

INTRODUCTION

The invention relates to a so-called bending restrictor, i.e. a bending limiter, for a rigid but resiliently pliable intervention cable. More specifically, the invention comprises articulation sleeves which separately are monoaxially articulating and which combined with straight pipe portions form a bending restrictor for such a rigid resilient pliable intervention cable.

BACKGROUND ART

There are many different types of intervention cables for working in a well. In wireline operation in a well one may use a smooth, thin cable with Ø about 3 mm with central electrical conductors and a smooth steel mantle. Other wireline cables may have central electrical conductors and a braided or twisted wire mantle. Wireline cables may also have a fibre core in order to increase the ultimate strength.

Rigid intervention cables of composite material for use in petroleum wells have such a high flexural rigidity that they may be fed into a well by rodding and is thus often called a rod. such intervention cables often have a diameter of about 10 mm and are resiliently pliable about a smallest allowable bending radius of about 2-4 m without being plastically deformed. The diameter of such rigid intervention cables may for practical applications be embodied in 8 mm, 10 mm, 12 mm, and up to 15 mm, with progressively increasing smallest allowable bending radius. The resilient intervention cable usually comprises one or more electrical and/or optical conductors in a central cable portion of diameter about 2-6 mm, and a composite fibre mantle outside on the core, filling in to the diameter of 10 mm. The composite fibre mantle may, in some embodiments have longitudinally directed carbon fibres as main component and a matrix of thermoplastics or cured plastics Upon rodding of such a rigid, resilient intervention cable from a drum on a petroleum installation at a petroleum well, via a well injector, it is imperative that it is not bent further than its smallest allowable bending radius. In this way a permanent curvature of the cable is avoided, and it essentially straightens itself completely out when it is released. Upon hauling of the intervention cable the same applies. It is usual in the background art to let an intervention cable run as an air span between a gooseneck on a well injector an intevention cable drum, and let the downward deflection control the amount of slack of the intervention and thus the length which at any instant resides between the gooseneck and the drum. This provides an uneven tension to the intervention cable when it enters the drum and is undesired. This also provides an uneven upper force from the intervention cable when it runs between the gooseneck and the injector, a uneven so-called back tension, and is also undesired. A freely suspended intervention which heaves irregularly above deck is also undesired with regard to the deck crew's safety and requires free space between the units, and thus much wasted space.

A free air span between the well injector and the drum also limits the options for utilizing the intermediate deck area for other activities. It is thus desirable to let the rigid intervention cable run through a fixed path between the injectors and the drum, through at least so-called "bending restrictor" at either ends of a possible rigid pipe path between those. A bending restrictor may in practice be an articulated pipe body which may be bent but wherein each articulation may only be bent so as for said intervention cable to be locally plied to a bending radius which is larger than or equal to the smallest allowable bending radius for the rigid intevention cable. It is essential that the intervention cable bending restrictor, which comprises a series of links, is non-compressible along its path, and a that it also may not extended to any mentionable degree, and that it offers a particular resistance against being further bent than said smallest allowable bending radius for a given intervention cable.

The applicant itself has a patent application on a bending restrictor: WO2011/096820 to Helvik, wherein said bending restrictor comprises short pipe sections with a spherical sector at either end, wherein two and two pipe sections are joined using a split sleeve with spherical sector shaped seats at either and, and whereupon is arranged a locking ring at either ends of said split sleeve. Either pipe section's end comprises a ring-shaped collar which forms a limit of each spherical sector towards the pipe section's straight portion. At the same time the ring shaped collar forms a shoulder which forms a limitation to how far the closed collar's end may be pivoted about the spherical sector. In this way a series of such pipe sections and closed collars form a bending restrictor which assembled form a tubular body. This tubular body is not much compressible in its longitudinal direction and little extendable, and for that matter works as a bending restrictor.

A problem related to the above mentioned bending restrictor of the background art of WO2011/096820 is, that upon bending until the collar meets the end of the sleeve in one peripheral point, and thus prevents further bending about the spherical articulation, large mutual point forces arise between those and deformation is initiated, either in the collar or in the split sleeve's end, which is just split and does not very well withstand hoop forces The bending restrictor according to WO2011/096820 thus, due to the point contact against the collar, a not well defined end point and thus a somewhat undefined smallest allowable bending radius. Further, it comprises many components, and because each link is rather short, several manipulations are required to assemble a desired length of bending restrictor. The spherical sectors with the ring collar against the pipe sections' ends and the resulting mutual point contact between the pipe sections end and the ring collar incurs large bending moments which are taken up between the pipe sections' spherical sector shaped end and the spherical sector seat, a bending moment which has a short arm, and may deform the split spherical sector seat to an undesired degree.

BRIEF SUMMARY OF THE INVENTION

The intervention bending restrictor according to the invention comprises a chain of pipe sections (2) linked by articulation sleeves (1) and arranged for allowing a rigid, resilient rod-shaped intervention cable pass through. The articulation sleeves (1) are provided with guide sheaves (5) for the intervention cable, and the pipe sections may be pivoted to a limited angle in the plane of the guide sheaves (5). The articulation sleeve (1) is arranged splittable in this plane and makes it practical and simple to assemble the bending restrictor.

The Invention Expressed as a Splittable Articulation Sleeve

The invention may be considered as a bending restrictor for a rigid, resilient rod-shaped intervention cable (0) comprising an articulation sleeve (1), wherein the articulation sleeve (1) which may also be named an articulation sleeve house, i.e. a sleeve-shaped house arranged for forming a bending articulation, is splittable into two half sleeves (1*h*), wherein each articulation sleeve (1) has spherical sector seats (12) arranged axially and oppositely directed at either ends of a central axial passage (12) for the intervention cable, wherein the spherical sector seats are arranged for receiving generally oppositely directed pipe sections (2) wherein each pipe section (2) comprises a straight pipe piece (20) with a spherical sector (21) at either end, wherein said spherical sector (21) has larger diameter than said straight pipe piece (20), please see FIG. 1, wherein outside of each spherical sector seat (12) is arranged outward widening flattened funnels (4) in the same plane which allow each pipe section (2) to be pivoted about its spherical seat (12) in this plane, and wherein said articulation sleeve (1) is splittable long this plane into two symmetrical sleeve halves (1*h*).

The Invention Expressed With a Complete Articulation Sleeve Which May be Split.

The same invention may be expressed as if its two sleeve halves are combined to one articulation sleeve, please see FIGS. 1, 2, 3, and 4: A bending restrictor for a rigid but resilient rod-shaped intervention cable (0), comprising a series of pipe sections (2) and articulation sleeves (1), wherein each pipe section (2) comprises a straight pipe piece (20) with a spherical sector (21) at either end, the articulation sleeve (1) comprises two axially oppositely directed spherical sector seats (12) for holding about each its pipe's (2) spherical sector (21), wherein the spherical sector seats (12) are arranged at either end of a central axial passage (13) for the intervention cable (0), two guide sheaves (5) each having a sheave groove (56) lying in the axial plane (15) of the articulation sleeve (1) and displaced laterally of the axial passage's (13) center so as for their sheave grooves (56) envelope the axial passage (13) of the intervention cable (0), wherein the articulation sleeve (1*h*) is provided with two oppositely directed and flattened pivot funnels (4), each pivot funnel (4) provided with its narrower end [directed] in towards each its spherical-sector seat (12), wherein the pivot funnel (4) in the axial plane (15) has a funnel shape allowing the pipe section's (2) straight pipe piece (29) to pivot about the spherical sector seat (12) in the axial plane (15), and wherein the pivot funnel's (4) funnel shape is flattened in a second axial plane (15T) orthogonally to the first axial plane (15), so as for the pipe sections (2) being forced to rotate only in said axial plane (15).

The central axial passage (13) has its mouths at either end in a spherical-sector seat (12).

In an embodiment of the invention the articulation sleeve (1) is a house which may be split about the axial plane (15) so as for at least the spherical-sector (21) and the pivot funnels (4) are split along their largest diameter for receiving the straight pipe portions (20) and their spherical sectors (21) at each end. Such splittable articulation sleeves (1) comprising two equal articulation sleeve half sleeves (1*h*, 1*h*) are shown in FIGS. 5, 6, and 7. An alternative to having a non-splittable articulation sleeve (1) is to let the spherical-sector seats (12) and the pivot funnels (4) be assembled from multiple components which are sled into an otherwise integral articulation sleeve, and is not further mentioned here.

The Invention Expressed as Two Sleeve Halves (1*h*, 1*h*) of an Articulation Sleeve (1)

The invention is, in an alternative definition, a bending restrictor for a rigid, resilient rod-shaped intervention cable, comprising pipe sections (2) and axial plane splittable articulation sleeves (1) comprising two assembled sleeve halves (1*h*, 1*h*), wherein each pipe section (2) comprises a straight pipe piece (20) with a spherical sector (21) at either end, wherein said spherical sector (21) has a larger diameter than the straight pipe piece (20), wherein each sleeve half (1*h*) has a spherical-sector half seat shell (12*h*) which, together with an opposite sleeve half (1*h*) forms a spherical-sector seat (12) for a spherical sector (21), wherein each sleeve half (1*h*) comprises two axially directed such sector half seat shells (12*h*), wherein each sleeve half (1*h*) preferably (in consideration of the rod-threading of the intervention cable) is provided with oppositely directed guide funnel half shells (41*h*) running from a wider end against each their spherical-sector half seat shell (12*h*) and each with its narrower end inward towards a central axial passage (13) for the intervention cable,—wherein each sleeve half (1*h*) is provided each with its guide sheave (5) which athwart axis is displaced with its guide-sheave's (5) groove's (56) radius laterally relative to the central axial passage (13) so as for two opposite assembled sleeve halves' (1*h*, 1*h*) guide sheaves' groove's (56) envelope the central axial passage (13) for the intervention cable, each sleeve half (1*h*) provided with two oppositely directed pivot-funnel shell halves (4*h*) each arranged with their narrower end adjacent to each its spherical-sector seat shell half (12*h*) and which each assembled with an oppositely sleeve half s (1*h*) pivot funnel shell half (4*h*) form opposite pivot funnels (4), lock elements (3) arranged for keeping opposite assembled sleeve halves (1*h*, 1*h*) ensemble and mutually locked and about two and two pipe sections (2) spherical sectors (21).

BRIEF FIGURE CAPTIONS

FIG. 1 is a longitudinal section in a main section plane (15) through an articulation sleeve (1) which holds ends of oppositely arranged pipe sections (2) of a bending restrictor according to the invention. The intervention cable bending restrictor is thread through by a rigid but resilient rod-shaped intervention cable (0). Each pipe section (2) comprises a straight pipe piece (20) with a spherical sector (21) in either end. The bending restrictor comprises a desired number of such pipe sections (2) linked by such articulation sleeves. The bending restrictor is laid on the platform between the drum and the well injector and forms a path for the intervention cable between those, please see FIG. 8. The pipe sections (2) is allowed to pivot in this main section plane and pivots in its respective spherical sector seats (21) as much as the aperture of the pivot funnel (4) allows.

FIG. 1*b* is a longitudinal section in a main section plane (15) through two articulation sleeves (1) that holds ends of numerous pipe sections (2) of a bending restrictor according to the invention. The intervention cable bending restrictor is thread through by a rigid but resilient rod-shaped intervention cable (0) that runs over the guide sheaves (5).

FIG. 2 is a longitudinal section about a plane perpendicular to the main section plane (15) through the articulation sleeve according to the invention in FIG. 1. The pipe sections (2) are not allowed to pivot in this main section plane. Please notice, however, that in an embodiment the articulation sleeve (1) is allowed to work as a swivel link between the two pipe sections (2).

FIG. 3 illustrates a section C-C from FIG. 1, orthogonal to the longitudinal main section plane (15) and the longitudinal section of FIG. 2. The section, which is also a partial view, is laid through the centre of two guide sheaves (5) between which runs a passage for the intervention cable (0).

FIG. 4 FIG. 4 is a cross-section along A-A from FIG. 1 and also B-B of FIG. 2. The cross-section is taken near an end of the articulation sleeve (1). The cross-section shows the flattened pivot funnel (4) which allows the pipe section (2) to pivot in the main section plane (15) but prevents the pipe section (2) from pivoting in the plane (15T) which is perpendicular to the main section plane (15). Reinforcement ribs extend out from the pivot funnel's outer face, parallel with the orthogonal plane (15T).

Figure 6:
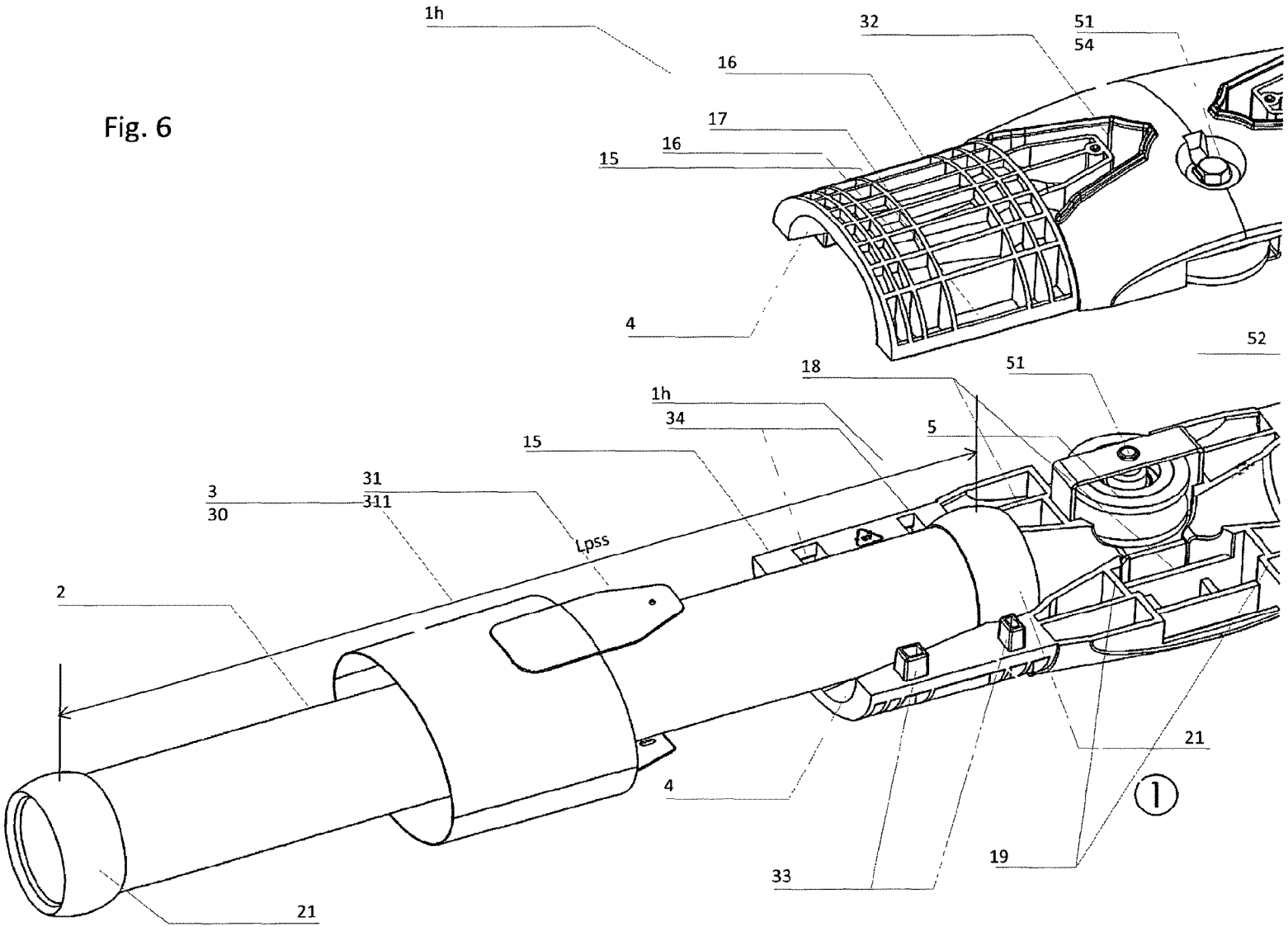
FIG. 6 is a perspective view of a portion of the same section of a bending restrictor according to the invention as shown in FIG. 5, but with the articulation sleeve in an exploded view, wherefrom an articulation sleeve (3) is axially retracted from either end and split along the main section plane (15).
Figure 7:
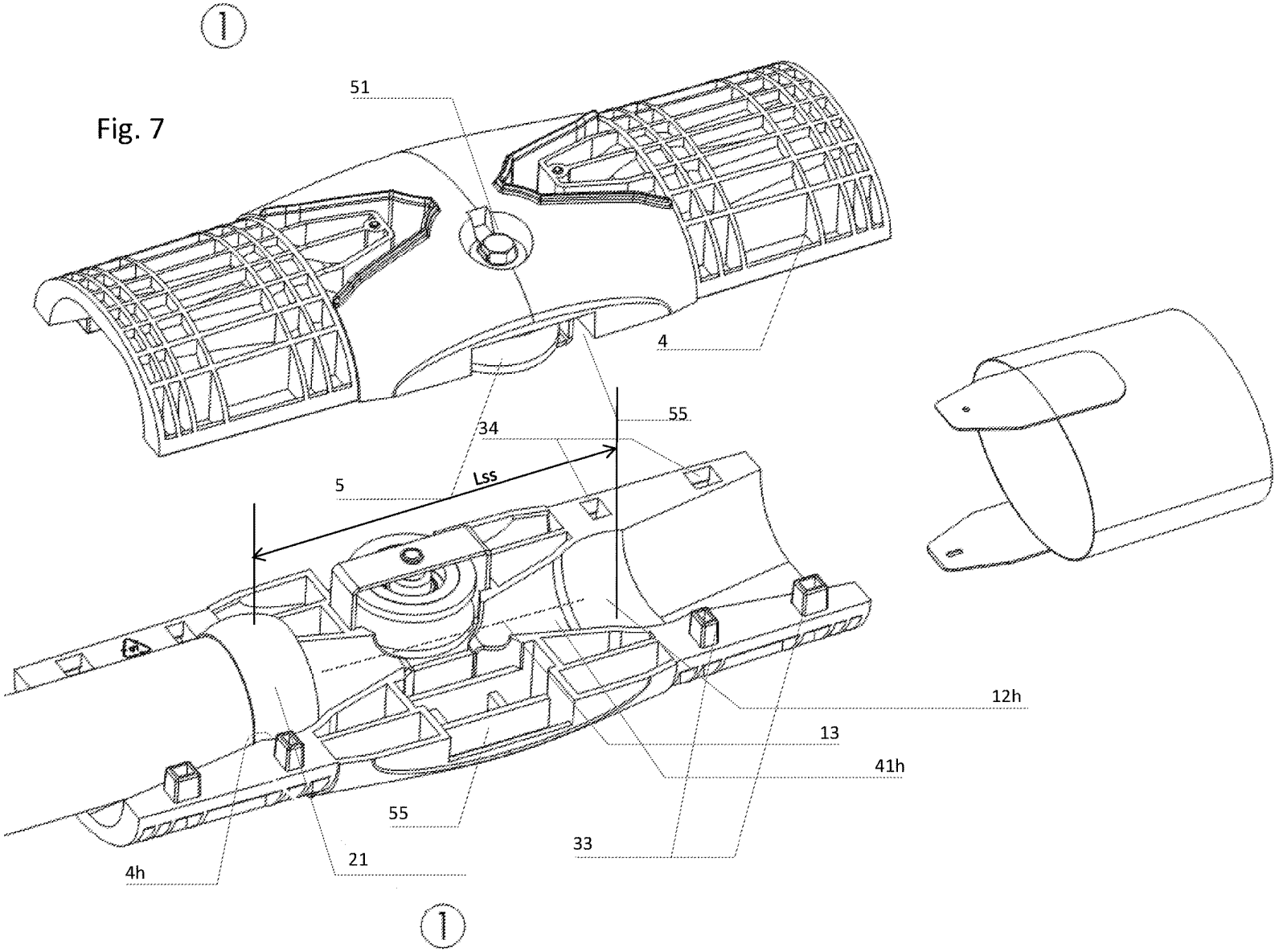

FIG. 7 shows a continuation of FIG. 6 with the entire articulation sleeve (1) split into an exploded perspective view split along the main section plane (15), and shows, in the lower half of the articulation sleeve (1) a spherical-sector shell half (12*h*) and its corresponding pivot funnel shell half (4*h*). The central axial passage (13) is shown past the guide sheave (5) mounted onto the lower half of the articulation sleeve (1). The other guide sheave (5) in the upper half of the articulation sleeve (1) will pass into an adjoining space about the central axial passage (13) when the articulation sleeve is assembled and the other guide sheave is in its place in the guide sheave recess (55). The two halves of the articulation sleeve (are symmetrical about the axial passage's centre line. A locking sleeve (30) opposite the one of FIG. 6 is shown to the right in this drawing.

Figure 8:
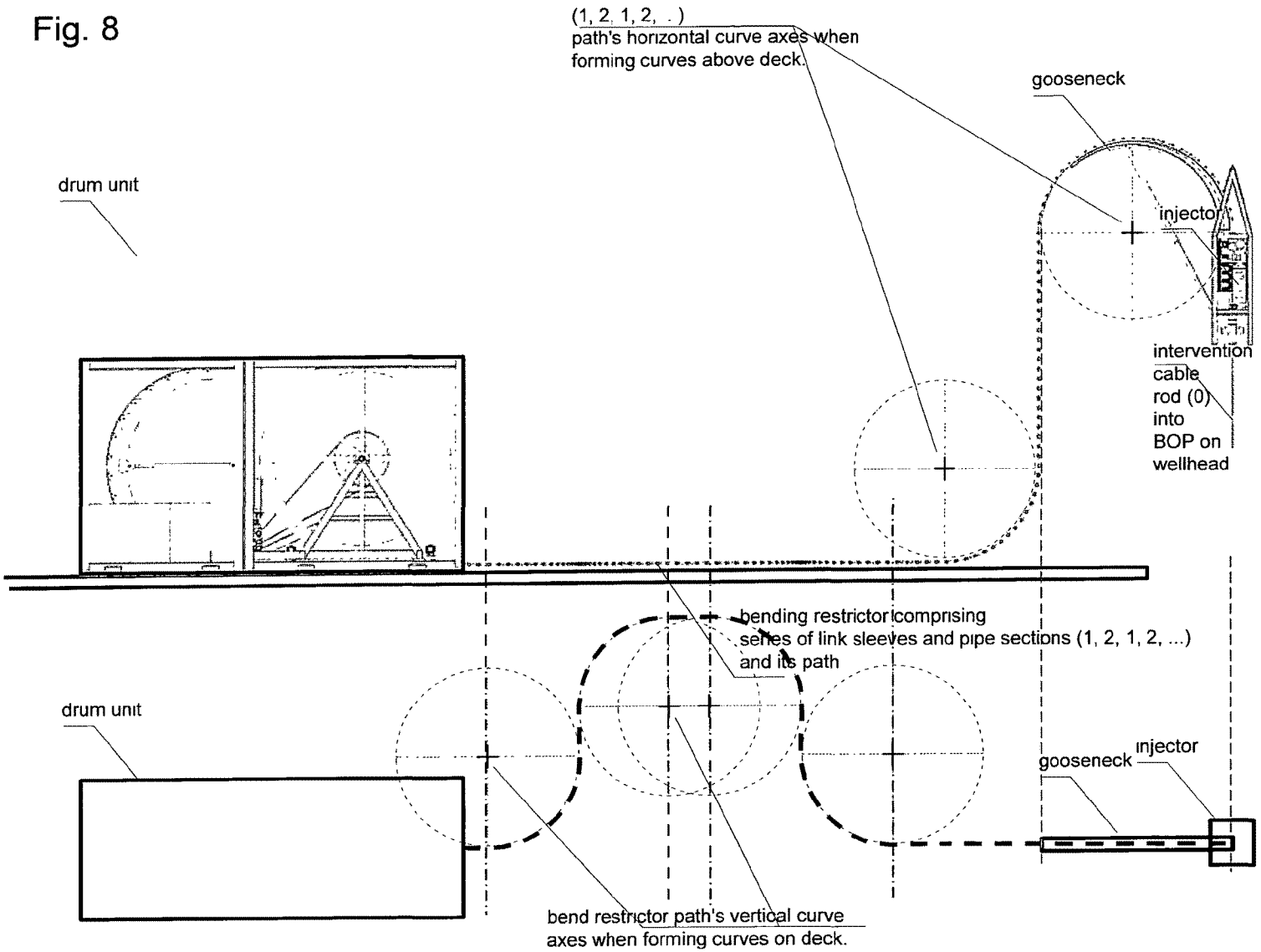

FIG. 8 shows in elevation view and plane view, both very simplified, a system for well intervention comprising a drum unit for a rigidly resilient flexible fibre reinforced cable and its bending restrictor path ahead to a wellhead injector for feeding the rigid cable down through a wellhead to a well or vice versa.

Figure 9:
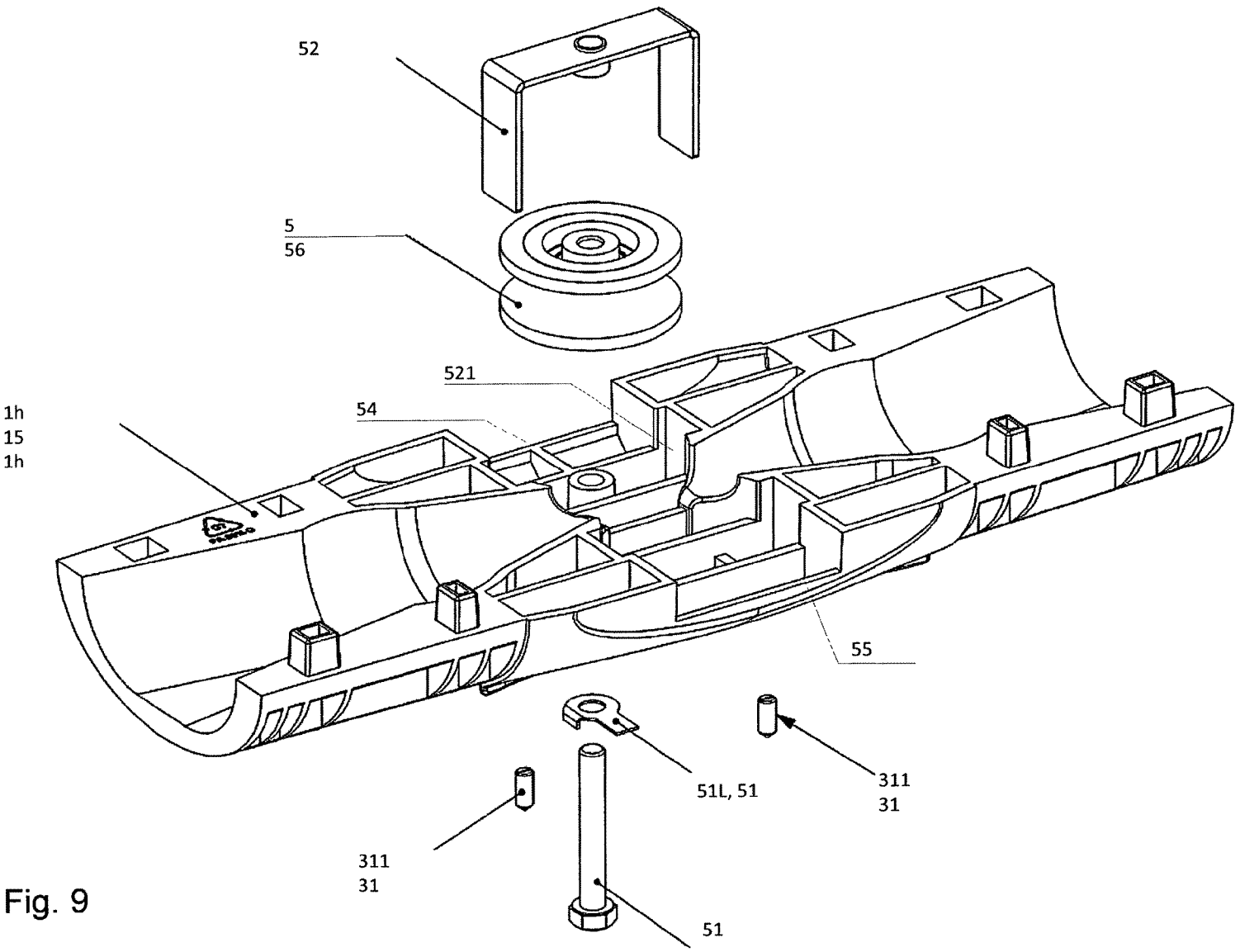

FIG. 9 is a perspective view of a sleeve half (1*h*) which illustrates details on the guide sheave (5) montage on a guide sheave axle bolt (51) through a fixed sleeve-shaped attachment through the wall of the sleeve half (1). and into a U-shaped guide sheave bracket (52) which spans over the guide sheave.

EMBODIMENTS OF THE INVENTION

The invention is a bending restrictor for a rigid but resilient rod-shaped intervention cable (0). The intervention cable bending restrictor comprises a series of pipe sections (2) and articulation sleeves (1), please see FIG. 8 for its application for forming a channel which extends as a hose which envelope the rod-shaped intervention cable between the drum unit and the injector.

Each pipe section (2) comprises a straight pipe piece (20) with a spherical sector (21) in either end. The spherical sector (21) has a larger diameter than the straight pipe piece's (20) diameter. Each articulation sleeve (1) comprises two axially oppositely directed spherical-sector seats (12) for holding about each its pipe's (2) spherical sector (21), please see FIGS. 1 and 2. The two spherical sector seats (12) are arranged at either end of a central axial passage (13) for the intervention cable (0), please see FIGS. 1, 2, and 7.

Guide Sheaves

Figure 1:
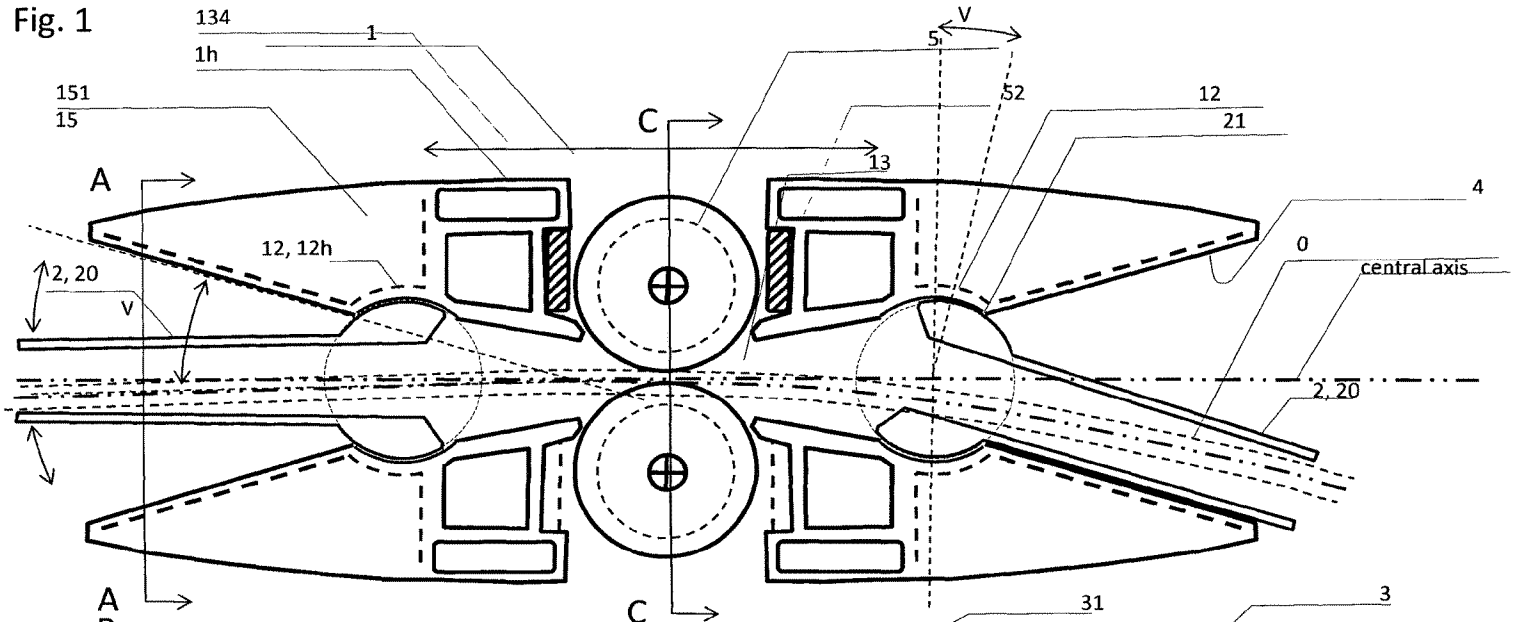
Figure 2:
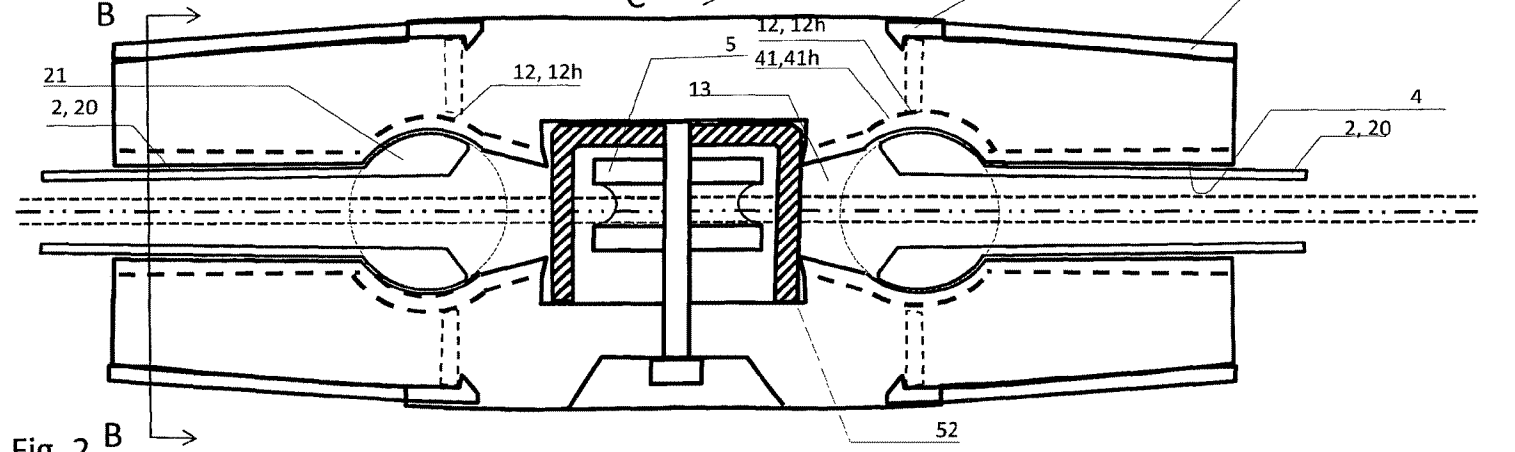
Figure 1B:
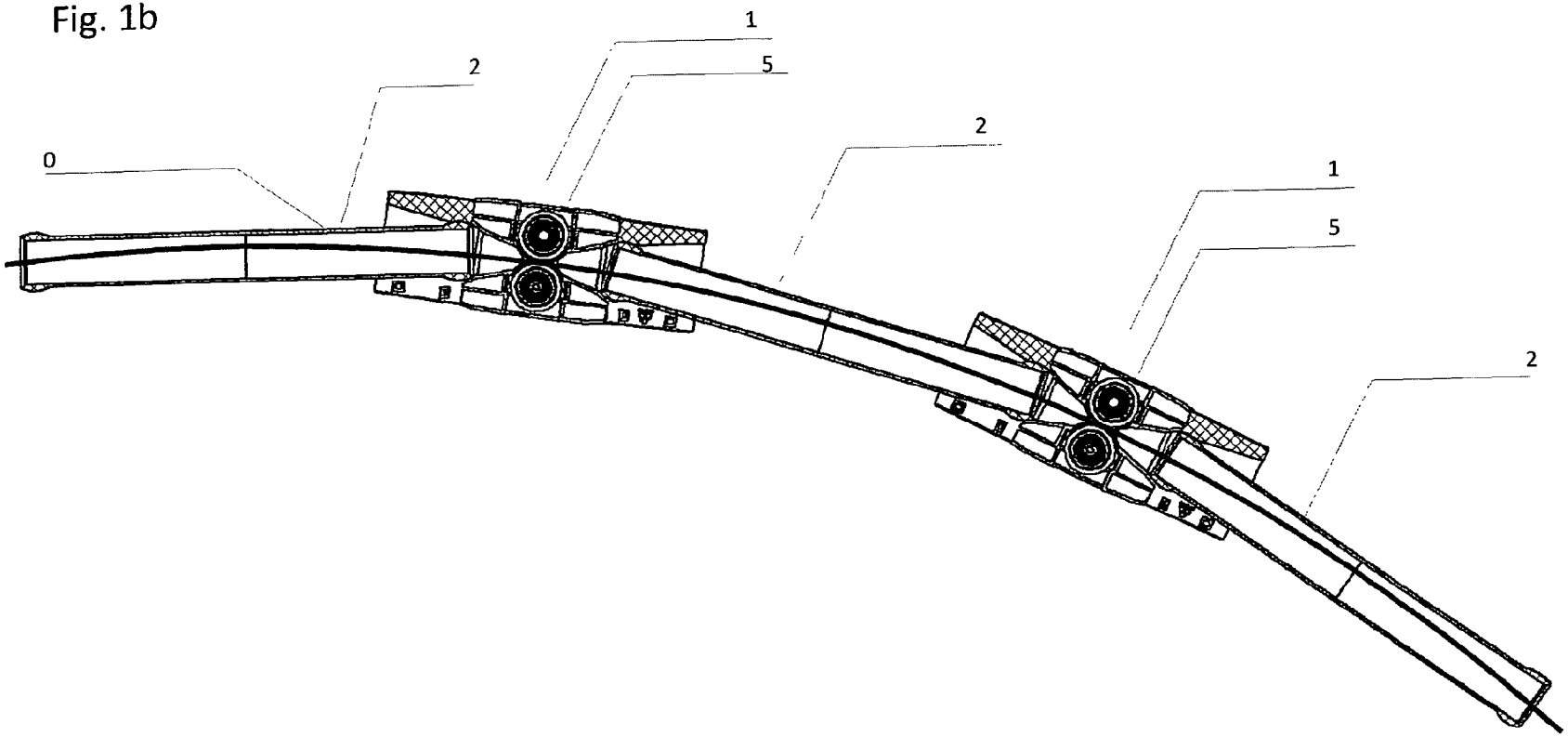

Two guide sheaves (5) each with its sheave groove (56) lies in an axial plane (15) which is a main plane in the articulation sleeve (1). The guide sheaves are in an embodiment provided with roller or ball bearings for reducing the friction. The guide sheaves are laterally displaced, each to its side, of the axial passage's (13) middle so as its sheave groove (56) to envelope the axial passage (13) for the intervention cable (0). This is illustrated in FIGS. 1, 2, and 3. When the rigid, resilient intervention cable is already thread between the guide sheaves (5, 5), it is enveloped by the two sheave grooves (56, 56), please see FIG. 3, and may not escape by slipping out laterally. In practice, thus a threaded, rigid, resilient intervention cable (0) mainly rest on the sheaves and will not touch any other part of the articulation sleeve's internally when it is in an operative state, regardless of how the bending restrictor is assembled from an alternating series of articulation sleeves and pipe sections (1, 2, 1, 2, . . . ) is laid, because the distance between pairs of guide sheaves (5, 5) is so short, in an embodiment 663 mm, please see below, and because the intervention cable (0) has such a high and homogenuous flexural rigidity that it will have even curvature. Longitudinally directed strong compression may of course incur the intervention cable to drag along a peripheral wall of the pipe section's (2) inner wall.

Pivot Funnels

The articulation sleeve (1) is provided with two opposite axially directed and flattened pivot funnels (4), wherein each pivot funnel (4) is arranged with its narrower end in towards each its spherical-sector seat (12). The two flattened pivot funnels are flattened in towards the same plane. In the axial plane (15) which is a main split plane through the articulation sleeve (1), the pivot funnel (4) has a funnel shape which allows the pipe section's (2) straight pipe piece (20) to pivot about the spherical-sector seat (12) in the axial plane (15) while the oval wall forms a widening to a desired angle relative to the centerline of the central passage (13). The pivot funnel's (4) funnel shape is flattened in a second axial plane (15T) orthogonally to the first axial plane (15) so as for forcing the pipe sections (2) to rotate about the ball sector seat (12) only in the first axial plane (15).

Swivel Function

By that very fact that the spherical-sector seats (12) and the pipe pieces' (20) spherical sectors (21) are just spherical, the articulation sleeve (1) will work as a swivel about each pipe section's (20) long axis. Thus a bending restrictor comprising the assembled series of an alternating series of articulation sleeves and pipe sections (1, 2, 1, 2, . . . ) be able to form any path comprising curves and possibly straight portions, only limited by the maximally allowed bending radius given by the geometry of the articulation sleeves' (1) and pipe sections' (2) geometry provides. A part of a curve may convert from lying along the ground, with vertical curve axis, to take off from the ground to a vertical direction with horizontal curve axis, to bend downwards again over a gooseneck, also with a horizontal curve axis, such as shown in FIG. 8. The bending restrictor may be attached to the deck, to another structure, and to the gooseneck along its desired path when this is determined, before or after threading of the rigid, resilient intervention cable (0).

Splittable Assembled Articulation Sleeve

Figure 5:
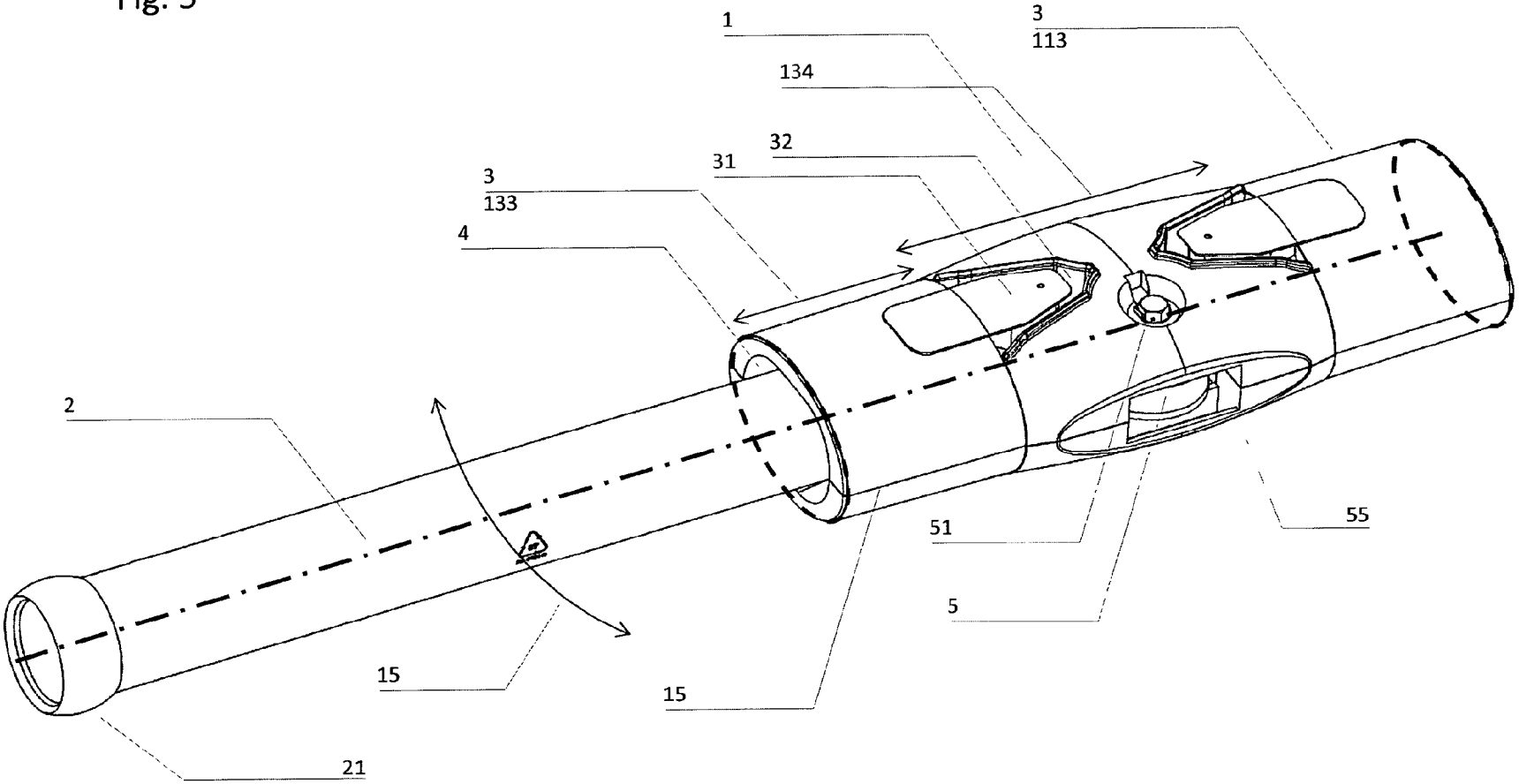
FIG. 5 is a perspective view of a section of a bending restrictor according to the invention. The intervention cable bending restrictor comprises a repeating series of such sections A section comprises a pipe section (2) with spherical sectors (21) in its ends, and an articulation sleeve (1) which is illustrated to surround and hold such a pipe end's spherical sector (21).

In an embodiment of the invention illustrated in FIGS. 5, 6, and 7, the bending restrictor's articulation sleeve (1) is assembled to comprise two opposite adjacent generally symmetrical sleeve halves (1*h*, 1*h*) which may be split about a common axial plane (15). This considerably reduces the cost of the production tool for the articulation sleeve (1).

Each sleeve half (1*h*) comprises, in an embodiment, the following parts:

- A spherical-sector half seat shell (12*h*) which, together with an opposite sleeve half's (1*h*) symmetrical, corresponding spherical-sector half seat shell (12*h*) form the spherical-sector seat (12) for a spherical sector (21) Two oppositely directed such sector half seat shells (12*h*) are arranged along the axial central passage (13).
- The guide sheave's (5) axle bolt (51) is mounted on the sleeve half (12*h*) laterally of the central axial passage (13) so as for two opposite adjacent half sleeves' (1*h*, 1*h*) grooves (56) envelope the central axial passage (13) for the intervention cable, please see FIG. 3.
- Preferably, guide funnels in towards the guide sheaves (5, 5) from each of the spherical-sector seat half shells (12*h*, 12*h*), (please see below).
- Two oppositely directed pivot funnel half shells (4*h*) each arranged with its narrower end adjacent to each its spherical-sector seat half shell (12*h*) and which each one together with an opposite adjacent assembled sleeve half's (1*h*) pivot funnel shell half (4*h*) form the opposite pivot funnels (4), please see FIG. 7.
- Locking elements (3), please see FIGS. 6 and 7, are arranged for keeping two opposite adjacent assembled sleeve halves (1*h*, 1*h*) together and mutually locked and about two and two pipe sections (2) spherical sectors (21), such as shown for the one adjacent pipe section (2) in the assembled articulation sleeve in FIG. 5

Guide Funnels

In an embodiment the sleeve house (1) is, in consideration of the threading of the intervention cable, provided with oppositely directed guide funnels (41) which extend from a wider end adjacent to each its spherical-sector seat (12) and with each its narrower end in towards the guide sheaves (5, 5) which are arranged enveloping the middle portion of the central axial passage (13) for the intervention cable. This is best shown in FIG. 7, wherein the guide funnel (41) here is shown embodied by its lower guide funnel shell half (41*h*). The two opposite adjacent guide funnels (41) thus constitute a considerable portion of the central axial passage (13) between the two opposite spherical-sector seats (12), except from an open portion between the narrower parts of the guide funnels, between the two guide sheaves (5, 5).

Lock Element

In the embodiment of the invention a lock element (3) comprises an axially directed locking sleeve (30) arranged for being thread in onto an end portion (133) of the two assembled sleeve halves (1*h*, 1*h*) in order to mutually lock them together such as shown in the assembled embodiment in FIG. 5, and in expanded view in FIGS. 6 and 7. The locking sleeve (30) may comprise an axial-parallel lock arm (31) arranged to extend into a corresponding axial parallel lock arm recess (32) in at least one of the two assembled shell halves (1*h*), and mutually provided with a lock (311), preferably a snap lock mechanism Such a lock mechanism is simple and safe to operate for a rig worker and does not require heavy tools.

Each guide sheave (5) is in an embodiment mounted in a U-shaped guide sheave bracket (52), please see FIG. 9 in particular, but also FIG. 2, FIG. 3, and FIG. 6, mounted longitudinally, parallel with the articulation sleeve's (1) main axis in a bracket slot (521) in said sleeve half (1*h*) and which is held by a through shaft (51) in a guide sheave axle sleeve (54) in the chassis of a sleeve half (1*h*).

The guide sheave (5) is in an embodiment mounted in a laterally open guide sheave recess (55) centered about the axial plane (15). in this way one may replace a guide sheave (5) if required, by only unscrewing its axle bolt (51) and withdraw the guide sheave out through its guide sheave recess (55), and put in a replacement guide sheave (5) and reassemble the axle bolt (51). This allows a guide sheave to be replaced without the bending restrictor according to the invention having to be opened in its locking elements (3) and is a considerable operative advantage.

The bending restrictor is, according to an embodiment of the invention, provided with external longitudinal and athwart reinforcement ribs (16, 17) over an end portion (133) externally on each half house (1*h*) in the range on the outside of the pivot funnel (4) and the spherical-sector seat (12). Those reinforcement ribs (16, 17) for a solid and extensive backing for forces exerted by the pipe section (20) and its spherical sector (21) against the inner surface of the spherical sector seat (12, 12*h*) and the pivot funnel (4). These external reinforcement ribs (16, 17) have their back portions along an even, curved surface which is arranged for being covered totally by the lock sleeve (30). In this way axially extending rigid portions of the articulation sleeve (1) are formed and thus have high bending stiffness against bending moments which are exerted from within by the pipe section (2) and its spherical sector (21).

Corresponding to the external reinforcement ribs are, in an embodiment of the invention, inward longitudinal and athwart reinforcement ribs (18, 19) in a middle portion (134), please see FIGS. 6 and 7, in a range between the end portions (133) of each half house (1*h*), wherein the mid portion extends in the range at least between the spherical-sector seats (4, 4). Each half sleeve's (1*h*) chassis is, in the guide funnel's (41) and the central axial passage's (13) range thus constituted by an outward shield wherein the reinforcement ribs (18, 19) extend inwards and supports or reinforces the guide funnel (41) and wherein other portions of the inward reinforcement ribs form the guide sheave recess (55) for the guide sheave's guide sheave bracket (52). The inward reinforcement ribs (18, 19(are thus connected in an external generally smooth, continuous shell which form the mid portion's outward surface, please see FIG. 5. The outward shell of the mid portion (134) thus provides bending stiffness to the articulation sleeve (1) against the bending moments which are exerted by the two adjacent pipe sections (2) via the end portions (133). In this way the mid portion (134) further contributes to the intervention cable bending restrictor according to the invention has a distinctly defined smallest allowable bending radius, and that it exerts considerable mechanical resistance against being bent further than this given smallest allowable bending radius In an embodiment shown in FIGS. 6, 7, and 9, each sleeve half's (1*h*) reinforcement ribs (16, 17, 18, 19) and other components such as locking dogs (33), locking recesses (34), etc. are formed having a projection orthogonally to the split plane (15) so as for being mould formed without so-called "undercut", i e. that they may be extracted without obstructing protrusions, from the mould's split plane. This is an advantage regardless whether the moulding is made in plastics or metal The Invention Expressed Comprising an Initially Integral Articulation Sleeve The invention may be seen as if its two sleeve halves initially are assembled to an integral articulation sleeve, which may also be called an articulation sleeve house, ie. a sleeve-shaped house arranged for forming a double ball- and seat articulation between to adjacent pipe sections. A spherical seat (12) is arranged axially oppositely directed in each end of the articulation sleeve (1) and arranged for receiving oppositely directed pipe sections (2) wherein each pipe section (2) comprises a straight pipe piece (20) with a spherical sector (21) in either end. The spherical sector (21) has larger diameter than the straight pipe piece (20). Axially beyoont each spherical sector seat (12) is arranged outward widening flattened funnels (4) in the same plane which allow each pipe section (2) to pivot about the ball seat (12) in this plane, and wherein the articulation sleeve (1) is splittable along this plane into two symmetrical sleeve halves (1*h*). The spherical sector seat (12) extends at least to the angle V to either sides past the spherical sector's (21) larger diameter out from the pipe's (2) center in the direction towards the guide sheaves (5) and the central passage (13), and an equally large angle (V) away from the guide funnel's (4) inner portion, so as for the pipe end's spherical sector (21) to pivot with the angle V to either sides without touching bottom against the spherical sector seat's end portion.

Compression- and Tensile Resistance

The spherical-sector seat (12) will, in addition to working as a pivot bearing for the spherical sector (21) also keep the spherical sector (21) in place, so as for [preventing] the pipe section (2) from move axially inwards or outwards. Thus the bending restrictor of the invention becomes incompressible to a degree determined by the material strength and the manufacturing tolerances.

Selection of Materials

In an embodiment of the invention the pipe sections are formed in aluminium, steel, or a plastic material such as polyamide. The articulation sleeve is formed in plastics, such as cured plastics, or aluminium, steel, bronze or other suitable material or alloy. The guide sheave (5) may be made in aluminium, steel, bronze, or plastics, e.g. nylon, and is mounted on an axle of steel with ball bearing of desired type. The lock sleeve (30) may advantageously be formed as an integral, smooth steel sleeve which is formed from 0.5-2 mm thickness plate, or in the form of a moulded plastic sleeve.

Swivel Function

In practice, according to an embodiment of the invention, the ball sector seat (12) is not tighter about the ball sector (21) than providing a swivel function in addition to the ball sector (21) may pivot in the ball sector seat (12). In this way the intervention cable bending restrictor shown in FIG. 8 adapt to the path it is given along the deck and up along inclinations, only limited by the bending restrictor's smallest allowed bending radius which is determined by the angular aperture of the guide [pivot] funnel (4), the length (Lss) between the spherical seats (12) and the length (Lpss) of the pipe sections (2).

Typical Dimensions

The pipe sections are about 500 mm of length, in an embodiment Lpss=477 mm center-to-center of the spherical sectors (21). The inner diameter Ø=50 mm, wall thickness 4 mm and the external diameter of the pipe sections is in an embodiment 58 mm. The distance between the spherical seats is about 150 mm, in an embodiment 186 mm center-to-center of the spherical seats (4) [(12)]. The length of a pipe section (2) and an articulation sleeve (1) thus build Lpss+Lss=477 mm+186 mm=663 mm along their path in the given embodiment. The aperture angle (2V) of the pivot funnel is about 10 to 30 degrees, in an embodiment 18 degrees, i.e. the largest angle the articulation sleeve (1) articulates between two adjacent pipe sections (2) Ten sections of an articulation sleeve (1) and a subsequent pipe section (2) thus provides a bending restrictor which describes a half circle of 10×18 degrees, i.e. 180 degrees arch. The intervention cable bending restrictor's length as measured along the chordal segments in a fully spanned half circle becomes in the given embodiment 10×663 mm, i.e. 6330 mm, which results in a smallest allowed bending radius of somewhat more than 2 m.

The sheave (5) diameter is in an embodiment 56 mm, and provided with a round groove (56) with diameter 15 mm, thus with a diameter of about 50 mm at the bottom of the groove (56).

In an embodiment of the invention such as shown in FIGS. 1 and 2 in section, and in FIGS. 6 and 7 in exploded view, the articulation sleeve (1) is provided with two axially oppositely directed guide funnels (41) running from their wider ends out adjacent to each its spherical sector seat (12) and inwardly with each their narrower end directed towards a central axial passage (13) for the intervention cable (0). This makes it it easy to thread a rigid intervention cable (0) through the assembled intervention cable bending restrictor of the invention. The intervention cable's (0) end will run without encountering internally projecting edges through a pipe section (2), and emerge from the pipe section's spherical ball sector (21) aperture. If the pipe section (2) forms an angle with the articulation sleeve's (1) axis, the intervention cable's end will encounter at sharp angle against the guide funnel's (41) wall before the intervention cable's end (0) encounters the one or the other sheave's (5) sheave groove (56) and enter this sheave groove. Thereby it will run from the sheave's (5) sheave groove (56) into the narrower end of the opposite guide funnel (41) and avoids encountering the wall of this, and enters the aperture of the opposite adjacent pipe section's (2) spherical sector (21). Thus the intervention cable's (0) end is thread past the actual articulation sleeve (1) The rodding of the intervention cable (0) may then continue through the entire bending restrictor.

The intervention cable (0) may potentially touch only the guide sheave (5) in the articulation sleeve (1), and the inner wall of the pipe section (5) when thread. The rigid, resilient intervention cable (0) is so rigid that if the bending restrictor of the invention is straight, i.e. not bent, the intervention cable will rest on the guide sheaves (5) and will not touch the inner wall of the pipe section 2. The same is valid also when the bending restrictor is bent, in little tensile- or pressure loaded state the intervention cable will run only over the guide sheaves (5).

The two opposite adjacent guide sheaves' sheave groove (56), please see FIG. 3, together form an almost closed envelope about the central passage (13) with the intervention cable (0). If the bending restrictor's path runs over from one arch in one plane, e.g. an arch attached to the deck, to a second arch in another plane, e.g. an arch from horizontally along the deck to vertically upwards to a gooseneck, the articulation sleeve (1) being at the transition will position itself in an intermediate position and the guide grooves (56) of the guide sheaves (5) will keep the intervention cable (0) in its correct place in the central axial passage (13).

Advantages of the Invention

The sleeve housing (1) and each sleeve half (1*h*) is designed so as for the entirety to have several non-obvious advantages.

a) Firstly, the two sleeve halves are symmetrical about their common axis through the central passage when they are assembled, and both are generally mirror-symmetrical about a central plane orthogonal to their common axis when they are assembled, except for their locking dogs and -recesses. Both are identical in their shape (due to the axial symmetry). Thus only one mould is required, a closed mould form) for forming one sleeve half (1*h*).

b) Further advantageous is the mechanical structure of each sleeve half (1*h*), because each sleeve half's continuous surface structure is constituted in the middle portion of a generally smooth outer shield which envelopes the athwart and longitudinal reinforcement ribs (18, 19) and support inner components and the central axial passage (13), while each sleeve half's (1*h*) end portions interior continuous surface structure is constituted by the ball sector half and the pivot funnel half (4*h*) which shall exert forces against the pipe's (2) ball sector (21) and straight pipe portion (20), and wherein the outer face of the continuous surface structure is reinforced by the protruding athwart and longitudinally extending reinforcement ribs (16, 17). Thus the assembled sleeve halves have a central surrounding shield at its largest diameter where they may be subject to mechanical shocks externally. In this way also the assembled shields' bending moment resistance largest at the middle such as naturally required. Likewise is formed, at their ends, an inner shield which forms smooth contact faces bearing against the adjacent pipes (2, 2) which may exert forces from internally. In this manner forces between the funnels' (4) inner surfaces and the pipe portions (2) are distributed over large areas and provides a low local mechanical pressure, in stead of forming point forces such as in the prior art which provides a high mechanical pressure.

In this way, through mechanical design, a well defined smallest allowable bending radius of the bending restrictor (1, 2) is defined, and attempts of bending beyond this smallest allowable bending radius is efficiently prevented and has small tolerances.

c) Further advantageous is the fact that when assembled the two sleeve halves form a rotatable axial swivel for each pipe's (2) spherical sector.

d) Further advantageous is the two assembled sleeve halves flattened funnel shape because each pipe is allowed to pivot about an athwart axis relative to the split plane (15), i.e. that each pipe may pivot in the split plane (15), but still, because the assembled sleeve halves (1*h*, 1*h*) constitute a swivel, the split plane (15) may be rotated for each new articulation. Thus the bending restrictor according to the inventor may form a desired path for a rigid intervention cable.

e) Further advantageous it is so that because each pipe which runs into the two sleeve halves (1*h*, 1*h*) is allowed to pivot in a common plane, i.e. the split plane (15), the rigid intervention cable will essentially be guided and thus bent over the one or the other of the two opposite guide sheaves (5), which both reside in this common split plane (15). Thus the rigid intervention cable for approximately every bending of the bending restrictor according to the invention essentially run over guide sheaves (5) and reside insignificantly towards the inner wall of the pipes (2). This essentially reduces the friction of the rigid intervention cable through the bending restrictor, a fact which is of considerable importance both when hauling the rigid intervention cable from a motorized well-injector tractor on a wellhead to a motorized cable drum on deck, and also of considerable importance when feeding out form the motorized cable drum on the deck via the intervention cable bending restrictor to the well injector tractor which feeds the rigid intervention cable down through the wellhead.

f) An advantageous feature is also that the sheaves (5) individually are replaceable via their recess (55) without splitting the sleeve housing (1).

In this manner we have demonstrated that the invention results in a series of essential advantages during operation, both of a mechanical protective character and with superior guiding properties for the rigid intervention cable

The invention claimed is:

1. An intervention cable bending restrictor for a rigid resilient rod-shaped well intervention cable, wherein said intervention cable bending restrictor comprises a sequence of pipe sections and articulation sleeves, each pipe section comprising a straight pipe piece with a spherical sector at each end, wherein each articulation sleeve comprises two axially oppositely directed spherical-sector-seats for holding about each pipe's spherical sector, wherein said spherical sector seats are arranged at either ends of a central axial passage for said intervention cable, wherein two guide sheaves each have a sheave groove lying in an axial plane of said articulation sleeve and are displaced laterally from a center of said central axial passage so the guide sheaves envelop said axial passage for said intervention cable, wherein said articulation sleeve is provided with two axially oppositely directed and flattened pivot funnels, each pivot funnel arranged with its narrower end directed inwardly towards each their spherical sector seat, wherein said pivot funnel in said axial plane has a funnel shape allowing said pipe section's straight pipe portion to pivot about said spherical sector seat in said axial plane, and wherein said pivot funnel's funnel shape is flattened in a second axial plane perpendicular to said first axial plane to force said pipe sections to pivot about their spherical sector only in said first axial plane.

2. The intervention cable bending restrictor according to claim 1, wherein said articulation sleeve is provided with two axially oppositely directed guide funnels widening towards each spherical sector seat and narrowing towards said central axial passage for said intervention cable.

3. The intervention cable bending restrictor according to claim 1, wherein each guide sheave has a transversely directed axis which is displaced laterally from said central axial passage so that said adjacent grooves of said guide sheaves envelop said central axial passage of said intervention cable.

4. The intervention cable bending restrictor according to claim 1, wherein said articulation sleeve comprises two opposite generally symmetrical sleeve halves which are split about a common axial split plane.

5. The intervention cable bending restrictor according to claim 4, wherein each articulation sleeve comprises:

a sleeve half with a spherical sector half shell seat which, together with an opposite sleeve half form the spherical sector seat for a spherical sector, two oppositely directed such sector half shell seats, wherein said guide sheave is provided with an axle bolt mounted on said sleeve half laterally displaced from the central axial passage, so that grooves of the opposite sleeve halves envelop said central axial passage for said intervention cable, two oppositely directed pivot funnel shell halves each arranged with a narrower end adjacent each spherical sector half shell seat and which each form the funnels, and lock elements arranged for keeping opposite assembled sleeve halves assembled and mutually locked and about two spherical sectors.

6. The intervention cable bending restrictor according to claim 5, wherein each sleeve half is provided with oppositely directed guide funnel shell halves extending from a wider end adjacent to each spherical sector seat half shell to a narrower end inward adjacent to said central axial passage for said intervention cable.

7. The intervention cable bending restrictor according to claim 5, wherein each lock element comprises an axially directed lock sleeve threaded over an end portion of said two assembled sleeve halves to mutually lock them.

8. The intervention cable bending restrictor according to claim 7, wherein said lock sleeve comprises an axially parallel protruding lock arm arranged for extending into a reciprocal axial parallel lock arm recess in at least one of said two assembled sleeve halves, and a snap lock mechanism.

9. The intervention cable bending restrictor according to claim 1, wherein each guide sheave is mounted in a U-shaped guide sheave bracket mounted longitudinally parallel with a longitudinal axis of said articulation sleeve in a bracket slot in said sleeve Dan and which is held by a through shaft in a guide sheave axle sleeve.

10. The bending restrictor according to claim 1, wherein said guide sheave is arranged in a laterally open guide sheave recess centered about said axial plane.

11. The intervention cable bending restrictor according to claim 4, wherein reinforcement ribs extend over an external end portion on each sleeve half.

12. The intervention cable bending restrictor according to claim 4, wherein internal reinforcement ribs extend longitudinally and laterally along an internal surface of a central portion of each sleeve half.

13. The intervention cable bending restrictor according to claim 12, wherein each sleeve has a chassis comprising an outer shield wherein the internal reinforcement ribs extend inward and support said guide funnel and form said guide sheave recess for said guide sheave bracket.

14. The intervention cable bending restrictor according to claim 11, wherein each said sleeve half is formed with a projection which projects orthogonally to said split plane so to enable each sleeve half to be pulled out of a mould without obstructing protrusions.

15. The intervention cable bending restrictor according to claim 2, wherein each guide sheave has a transversely directed axis which is displaced laterally from said central axial passage so that said grooves of adjacent guide sheaves envelop said central axial passage of said intervention cable.

16. The intervention cable bending restrictor according to claim 2, wherein said articulation sleeve comprises two opposite generally symmetrical sleeve halves which may be split about a common axial plane.

17. The intervention cable bending restrictor according to claim 3, wherein said articulation sleeve comprises two opposite generally symmetrical sleeve halves which may be split about a common axial plane.

18. The intervention cable bending restrictor according to claim 2, wherein each guide sheave is mounted in a U-shaped guide sheave bracket mounted longitudinally parallel with a longitudinal axis of said articulation sleeve in a bracket slot in said sleeve Dan and which is held by a through shaft in a guide sheave axle sleeve.

19. The intervention cable bending restrictor according to claim 3, wherein each guide sheave is mounted in a U-shaped guide sheave bracket mounted longitudinally parallel with a longitudinal axis of said articulation sleeve in a bracket slot in said sleeve Dan and which is held by a through shaft in a guide sheave axle sleeve.

20. The intervention cable bending restrictor according to claim 4, wherein each guide sheave is mounted in a U-shaped guide sheave bracket mounted longitudinally parallel with a longitudinal axis of said articulation sleeve in a bracket slot in said sleeve Dan and which is held by a through shaft in a guide sheave axle sleeve.

* * * * *